US010357702B2

(12) United States Patent
Strasser et al.

(10) Patent No.: US 10,357,702 B2
(45) Date of Patent: Jul. 23, 2019

(54) SYSTEM FOR CONTROLLING THE USE OF AN EXERCISE COURSE BY A PERSON IN A CLIMBING PARK

(71) Applicant: Bornack GmbH& Co. KG, Ilsfeld (DE)

(72) Inventors: Philipp Strasser, Hinterbrühl (AT); Klaus Bornack, Schreyerhof (DE)

(73) Assignee: Bornack GmbH & CO. KG, Ilsfeld (DE)

( * ) Notice: Subject to any disclaimer, the term of this patent is extended or adjusted under 35 U.S.C. 154(b) by 231 days.

(21) Appl. No.: 15/531,062

(22) PCT Filed: Nov. 25, 2015

(86) PCT No.: PCT/EP2015/077604
§ 371 (c)(1),
(2) Date: Aug. 7, 2017

(87) PCT Pub. No.: WO2016/083436
PCT Pub. Date: Jun. 2, 2016

(65) Prior Publication Data

US 2017/0326429 A1 Nov. 16, 2017

(30) Foreign Application Priority Data

Nov. 26, 2014 (DE) ..... 10 2014 117 329

(51) Int. Cl.
*A63G 21/22* (2006.01)
*A63B 9/00* (2006.01)
(Continued)

(52) U.S. Cl.
CPC ..... *A63B 71/0054* (2013.01); *A62B 35/0056* (2013.01); *A62B 35/0068* (2013.01);
(Continued)

(58) Field of Classification Search
CPC ... A63B 71/0054; A63B 24/0087; A63B 9/00; A63B 2071/0081; A63B 2225/54;
(Continued)

(56) References Cited

U.S. PATENT DOCUMENTS 8,387,218 B2 3/2013 Strasser
9,174,072 B2 11/2015 Strasser
(Continued)

FOREIGN PATENT DOCUMENTS

DE 10 2012 212 192 A1 1/2014
WO WO 2008049143 A1 5/2008
(Continued)

*Primary Examiner* — Andrew S Lo
(74) *Attorney, Agent, or Firm* — Robert A. Blaha; Smith Tempel Blaha LLC

(57) ABSTRACT

A system for controlling use of an exercise course by a person in a climbing park has a guiding element, which extends along a longitudinal direction and along which a person can move between a connecting section of the guiding element and a disconnecting section of the guiding element. A securing device is movably attachable along the guiding element between the connecting section and the disconnecting section. The securing device is connectable to the guiding element in the connecting section and is disconnectable from the guiding element in the disconnecting section. An identification device is configured such that, by the identification device, at least a connecting of the securing device within the identification section is identifiable, such that an occupancy of the guiding element with another person is identifiable therewith. An actuating device of the securing device is controllable with the identification device, such that the actuating device of the securing device is adjustable in a clearance position and, upon identification of the occupancy of the guiding element by another person, in a blocking mode. The actuating device of the securing device is coupled with the securing device, such that, in the
(Continued)

Figure 1:
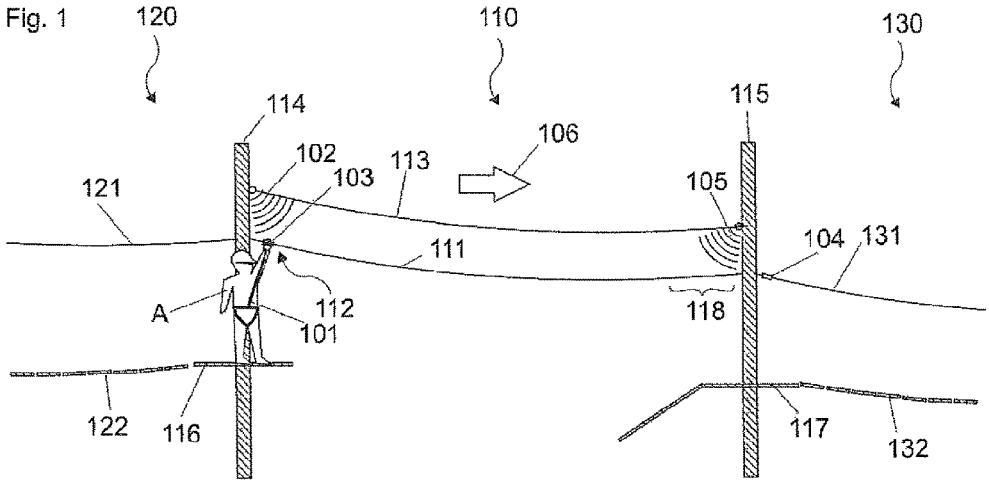

blocking mode, a connecting of the securing device in the connecting section and/or a displacing of the securing device along the guiding element is blocked.

16 Claims, 7 Drawing Sheets

(51) Int. Cl.
*A62B 35/00* (2006.01)
*A63B 71/00* (2006.01)
*A63B 24/00* (2006.01)
*A63G 31/00* (2006.01)

(52) U.S. Cl.
CPC ..... *A63B 9/00* (2013.01); *A63B 24/0087* (2013.01); *A63G 21/22* (2013.01); *A63G 31/00* (2013.01); *A63B 2071/0081* (2013.01); *A63B 2225/54* (2013.01)

(58) Field of Classification Search
CPC .... A63G 31/00; A63G 21/22; A62B 35/0068; A62B 35/0056; F16D 63/008; B61H 9/02; B61L 23/14; B61L 21/10; B61L 23/34; B61B 7/00
See application file for complete search history.

(56) References Cited

U.S. PATENT DOCUMENTS

2009/0014259 A1* 1/2009 Cylvick ..... A63G 21/22 188/42
2016/0046305 A1* 2/2016 Cylvick ..... B61L 23/14 701/19
2016/0361660 A1* 12/2016 Hreniuk-Mitchell ..... A63G 21/22
2017/0043268 A1* 2/2017 Briggs ..... A63G 31/02
2017/0157433 A1* 6/2017 Cylvick ..... A62B 1/20
2017/0327129 A1* 11/2017 Cylvick ..... B61B 12/002
2018/0369700 A1* 12/2018 Cylvick ..... B61L 23/14

FOREIGN PATENT DOCUMENTS

WO WO 2009098249 A1 8/2009
WO WO 2014009392 A2 1/2014

* cited by examiner

SYSTEM FOR CONTROLLING THE USE OF AN EXERCISE COURSE BY A PERSON IN A CLIMBING PARK

CROSS-REFERENCE TO RELATED APPLICATIONS

This patent application is a national phase application derived from the international patent application number PCT/EP2015/077604 filed on Nov. 25, 2015, the disclosure of which is incorporated herein by reference in its entirety, and claims the benefit of the filing date of the German patent application number 10 2014 117 329.5, filed Nov. 26, 2014, the disclosures of which are hereby incorporated herein by reference in their entirety.

TECHNICAL FIELD

The present invention relates to a system for controlling a use of an exercise course by a person in a climbing park. Furthermore, the present invention relates to a method for operating a system for controlling a use of an exercise course by a person in a climbing park.

TECHNOLOGICAL BACKGROUND

In climbing parks, and in particular in high wire gardens, there are frequently exercise courses, which may not be used by more than one person at the same time. Thus, it may be that an exercise course is designed only for the weight of one person, and an overload must be prevented.

An exercise course may have, for example, a zip line (flyingfox), which may never be used by two or more participants at the same time, because dangerous collisions may arise thereby.

Hence, it is necessary that strict safety rules are adhered to in climbing parks in order to ensure a sufficient safety (or security) during the exercise courses.

WO 2008/049143 A1 discloses a self-securing set having two securing devices, which can be connected (or hooked in) at securing positions and to which a person is secured. Blocking devices of the connectable securing devices are coupled by a communication means, such that a securing means for the connectable securing devices is provided, which blocks against opening upon connecting a connectable securing device at the securing position and upon actuating the securing means of the connectable securing device by means of its blocking device.

WO 2009/098249 A1 discloses a self-securing device having a securing appliance, which is connectable to a securing means and which secures person. The connectable securing appliance has a recess, which is closable for receiving a rope and which is closable (or lockable) by a barrier. The barrier is unlockable by an unblocking element with clearance of the recess. A blocking element blocks the recess. The unblocking element and the blocking element are directly or indirectly attached to the rope separately from each other. The unblocking element is movable relatively to the connected securing appliance and can be attached to the rope upon clearance of the recess. Furthermore, the connectable securing appliance with the unblocking element attached thereto can be moved only in a connected state to the blocking element. The attachment of the unblocking element to the connectable securing appliance is releasable during the blocking process.

SUMMARY

There may be a need to establish a surveillance system, by which the occupancy of an exercise course of a climbing park can be detected.

According to exemplary embodiment examples, there is provided a system for controlling a use of an exercise course by a person in particular in a climbing park, and a method for operating the system, according to the appended independent claims.

According to a first aspect of the present invention, there is described a system for controlling a use of an exercise course by a person in particular in a climbing park (for example a high rope garden, an adventure jungle, a high wire garden, a climbing jungle) or in areas of occupational safety. The climbing park has a guiding element (for example a steel rope), which extends along a longitudinal direction, and along which a person can move between a connecting (or hooking-in) section of the guiding element and a disconnecting (or hooking-out) section of the guiding element, wherein an identification section is formed in the connecting section.

The system has a securing device for securing a person to the guiding element, wherein the securing device is attachable shiftably (or movably) along the guiding element between the connecting section and the disconnecting section. The securing device is connectable to the guiding element in the connecting section and is disconnectable from the guiding element in the disconnecting section.

Furthermore, the system has an identification device, which is configured such that at least a connecting of the securing device within the identification section is identifiable by the identification device, such that an occupancy of the guiding element by another person is identifiable therewith.

Furthermore, the system has an actuating device of the securing device (in the following also referred to as a key device), which is controllable by the identification device, such that the actuating device of the securing device is adjustable in a clearance mode and, upon identification of the occupancy of the guiding element by another person, in a blocking mode. The actuating device of the securing device is coupled with the securing device, such that, in the blocking mode, a connecting of the securing device in the connecting section and/or a shifting respectively a moving of the securing device along the guiding element is blocked.

According to a further aspect of the present invention, there is described a method for operating the system, which is described above, for controlling a use of an exercise course by a person in a climbing park. According to the method, a connecting of the securing device within the identification device is identified by the identification device, such that an occupancy of the guiding element by another person is identifiable thereby. Furthermore, the actuating device of the securing device is controlled, by the identification device, in the clearance mode or, if the guiding element is occupied by another person, in the blocking mode.

By the above-described climbing park, there is described, for example, a high rope garden or the like, in which persons can perform different exercise courses, such as for example ability (or skill) exercises or zip lines, at large heights. A person may be located in the exercise course at a described point in time. Accordingly, a preceding exercise course (pre-exercise course) or a subsequent exercise course (follow-up exercise course) may join relative to the exercise course. In other words, a person may thus complete the preceding exercise course, subsequently perform the exercise course, and may, after the performing of the exercise course, perform the subsequent exercise course.

The guiding element may for example be a securing rope, which may be suspended along the exercise course and strained (or tensioned). Furthermore, the guiding element may also have, for example, a securing rail or a securing chain. The guiding element may extend for example along the complete exercise course. For example, the climbing park may have two masts, which may be arranged at a distance from each other (or mutually spaced), and between which the guiding element may be attached. In particular, at the beginning of the exercise course, the guiding element may have a connecting (or hooking-in) section, in which the person may connect to the guiding element by the securing device. Towards the end of the exercise course, the guiding element may have a disconnecting (or hooking-out) section, within which the person may disconnect from the guiding element.

The securing device may serve for securing the person to the guiding element. The securing device may have, for example, a hook, by which the person may connect to the guiding element. In a preferred embodiment described below, the securing device may have a first connectable securing device (e.g. a carabiner element), or a first and a second connectable securing device (e.g. a carabiner element). In addition or alternatively, the securing device may be coupled to the guiding element for securing the person for example also by a magnetic coupling, for example via electromagnets.

The identification device may provide the information "exercise course occupied" or "exercise course not occupied". The identification device may identify a connecting of the securing device within an identification section. Thereby, the status "exercise course occupied" or "exercise course not occupied" may be adjusted as a function of the safety (or security) prescription of the exercise course. For example, a particular type of an exercise course (e.g. zip lines) may be performed only by one person at a time. Thus, the identification device may output the status "exercise course occupied" already after the detection of one person. Other exercise courses may allow, for example, that plural persons perform the exercise course at the same time. In this case, the identification device may determine the passing-by of a predetermined number of persons, and may output the status "exercise course occupied" only after exceeding the predetermined number of persons.

The identification section may be defined in particular within the connecting section. The identification device may determine, for example, whether a person passes by at the identification section, such that an occupancy of the guiding element within the exercise course may be concluded. For this purpose, for example, and as is described further below, the identification device may have a RFID reader unit. Furthermore, the identification device may also have a barrier (optical light barrier, or mechanical barrier), wherein a passing-by at the barrier can be identified, such that a connecting of the securing device within the identification section can be concluded. For this purpose, the identification device may also have a camera, such that a passing-by of the person can be detected optically.

Furthermore, the identification device may have a contact sensor, which may be formed in the identification section, such that, upon a contact of the securing device with the contact sensor, an occupancy of the guiding element within the exercise course may be concluded.

The identification device may detect a disconnecting of the person and/or a further passing-by of the person at the disconnecting section, for example via a further RFID reader unit arranged in the region of the disconnecting section, a further contact sensor arranged in the disconnecting section and/or the or a further camera arranged in the region of the disconnecting section, such that an end of the occupancy of the guiding element may be concluded.

The actuating device of the securing device (the key device) may be adjusted by the identification device in a clearance mode and in a blocking mode as a function of the occupancy of the exercise course and/or of the guiding element with a person. If the identification device detects no person within the exercise course and/or no person, who may be coupled to the guiding element, the key device may be adjusted in a clearance mode. In the clearance mode, the securing device may be coupled to the guiding element in the connecting section and/or may be shifted along the guiding element.

If the identification device detects a person within the exercise course and/or a person coupled to the guiding element, the key device may be adjusted in a blocking mode. In the blocking mode, the securing device cannot be coupled to the guiding element in the connecting section and/or cannot be shifted along the guiding element.

Herein, the key device may be integrated in the securing device or can be coupled to (or with) the guiding element. For example, the securing device may have a securing system arranged within the key device, such that an opening of the securing device for coupling to the guiding element may be blocked in the blocking mode. In the case that the securing device has a rope pulley, the key device may be formed, for example, as a rope brake or a pulley brake, so as to prevent, in the blocking mode, a rolling and thus a shifting along the guiding element. In this case, the securing device may have, for example, an actuating element, which is (electrically) controllable and which may be controlled by the identification device wire-bound or by radio. The actuating device of the securing device may further be switched in the clearance mode or in the blocking mode by a mechanical key pin-key lock-system that is described below. Alternatively, the actuating device of the securing device may have, for example, a magnet (electromagnet), which may be attached e.g. to the guiding element, wherein the magnet may be controllable by the identification device. The securing device may have a corresponding magnet (electromagnet), which may act as the blocking device that is described below. The magnet, as an electromagnet, attached to the guiding element may be supplied, for example, selectively with energy, so as to possibly adjust or to possibly block the securing device (and/or its first or second securing device) in an opening position by the blocking device as magnets.

Furthermore, and as is described in detail further below, the key device may be fixed to the guiding element. In the clearance mode, the key device may enable that the securing device can be coupled to the guiding element in the connecting section and can be shifted along the guiding element. In the blocking mode, the key device may block and may make impossible a connecting of the securing device to the guiding element in the connecting section and/or may block and may prevent a shifting of the securing device along the guiding element. For example, in the blocking mode, a stopper element may move out of the key device, so as to possibly prevent a shifting of the securing device. Furthermore, and is described in more detail further below, the securing device may have an opening mechanism, which may be activated or blocked by the key device.

With the present invention, a system is described, which, in particular by the identification device, may identify the occupancy of the exercise course, and based thereon may control a key device, which may release or may block a coupling and a shifting of the security device along a guiding element within the exercise course. Thus, a multiple occupancy of an exercise course with too many persons can be prevented. Thereby, an overload of the exercise course and accidents due to a collision of plural persons within the exercise course may be prevented. Thus, the security and safety for persons when performing the exercise course may be increased by the system according to the invention.

According to an exemplary embodiment example, the securing device may have a rope pulley, to which the person may be attached. As has been described above, the key device may, for example, block the pulley of the rope pulley or block a connection of the rope pulley to the guiding element, if the identification device prescribes the status "exercise course occupied".

According to an exemplary embodiment example, the securing device may have a first connectable securing device (e.g. a first carabiner element), to which the person may be fixed. The key device may be integrated, for example, in the connectable securing device and/or in the first connectable securing device, as has been described above, and may block or allow an opening or a shifting (or displacement) of the connectable securing device with respect to the guiding element as a function of the determined occupancy status by the identification device.

According to an exemplary embodiment example, the securing device may have a second connectable securing device (e.g. a second carabiner element), to which the person may be fixed. The securing device may be formed, such that either the first connectable securing device or the second connectable securing device may be adjustable in an opening position for coupling or decoupling. According to an exemplary embodiment example, the key device may communicate in particular with the securing device, such that an opening of the second connectable securing device may be selectively blockable.

According to an exemplary embodiment example, the first connectable securing device may have a first blocking device, and the second connectable securing device may have a second blocking device. The first blocking device may selectively control the opening position of the first connectable securing device, and the second blocking device may selectively control the opening position of the second connectable securing device.

The first blocking device and the second blocking device may be embodied, for example, as locking pins. In the case that the key device has, respectively, a first actuating element and a second actuating element, which may be arranged accordingly in the first connectable securing device and in the second connectable securing device, the first actuating element may control the first blocking device in the clearance (or release) mode or in the blocking mode, and the second actuating element may control the second blocking device in the clearance mode or the blocking mode.

According to an exemplary embodiment example, the securing device may have a coupling means, which may be coupled with the first blocking device and the second blocking device, such that only one of the connectable securing devices and/or their blocking devices may be adjustable in an opening position, while the other blocking device may be adjusted in the blocking mode. The coupling means may be embodied, for example, mechanically as a Bowden cable and be coupled, respectively, with the first blocking device and the second blocking device. Furthermore, the coupling means may be embodied for acting electrically, for acting pneumatically, or for acting hydraulically. The coupling means may be controllable via electrical actuating elements, for example, wire-bound or by radio (or wireless). Securing devices having a coupling means are described, for example, in WO 2008/049143 A1 and in WO 2009/098249 A1.

According to an exemplary embodiment example, the key device may be fixable to the guiding rope in the connection section. The key device may have a key pin. At least the first connectable securing device may have a key lock, which may be coupleable with the key pin. The first connectable securing device may be configured such that, upon coupling of the key lock with the key pin, the coupling means may control the second blocking device, such that the second connectable securing device and/or the second blocking device may be adjustable in the opening position. Upon coupling the key pin in the key lock, for example, a string mechanism or an electrical pulse may be activated, which may prompt the coupling element to possibly adjust or to possibly block the second blocking device in the opening position.

According to an exemplary embodiment example, the key pin may be adjustable in an active position and in a passive position (for example pullable in and movable out), wherein, in the active position, the key pin may be coupleable with the key lock, and, in the passive position, a coupling of the key pin with the key lock may be blocked. In the blocking mode of the key device, the key pin may thus be adjusted in the passive position, such that a coupling with the key lock of the first connectable securing device may be blocked. Accordingly, for example, the coupling means may not be actuated, such that the coupling means may not release the second blocking device of the second connectable securing device and may not move in the opening position.

According to an exemplary embodiment example, the key device may have an adjusting device for adjusting the key pin, wherein the adjusting device may have an electromagnet and/or a servo motor. The adjusting device may be coupled with the identification device for signal transmission, such that the identification device possibly controls the adjusting device as a function of the occupancy status of the guiding element of the exercise course.

According to an exemplary embodiment example, and as has been described further above, the identification device may have a RFID reader unit, which may be configured to detect a RFID transponder of the securing device or of the person, so as to possibly identify a passing-by of the person at the identification device. By the RFID reader unit and the RFID transponder, for example, a simple passing-by of the person A may be detected. In addition, the RFID transponder may have a particular code, which may be detected by the RFID reader unit. Thus, it may be determined in addition, which RFID transponder is about to pass by the RFID reader unit. Thus, for example, a specific person, who may carry the particular RFID transponder, can be identified. Thereby, it may be determined, for example, how often the person has already performed the exercise course. Furthermore, the person may be localized in the climbing park by a central control unit.

According to an exemplary embodiment example, the system may have a further identification device. The further identification device may be coupled to the guiding element, such that, by the further identification device, a disconnecting of the securing device within the disconnecting section may be identifiable, such that the occupancy of the guiding element may further be identifiable therewith. The further identification device may be embodied as the same embodiment examples as those that have been explained above for the identification device.

According to an exemplary embodiment example, the identification device and the further identification device may be coupled with each other for exchanging signals.

According to an exemplary embodiment example, the identification device and the further identification device may be coupled with the guiding element, such that signals may be exchangeable along the guiding element between the identification device and the further identification device.

It is noted that the embodiments described herein represent only a limited selection of possible embodiment variants of the invention. Thus, it is possible to combine the features of individual embodiments in a suitable manner, such that a plurality of different embodiment examples are to be considered as evidently disclosed for the skilled person with the explicit embodiment variants herein. In particular, some embodiments of the invention are described by device claims and other embodiments of the invention are described by method claims. However, it will become evident for the skilled person upon reading this application that, unless indicated explicitly to the contrary, in addition to a combination of features, which belong to one type of subject of the invention, also an arbitrary combination of features is possible, which belongs to different types of subjects of the invention.

BRIEF DESCRIPTION DRAWINGS

Figure 2:
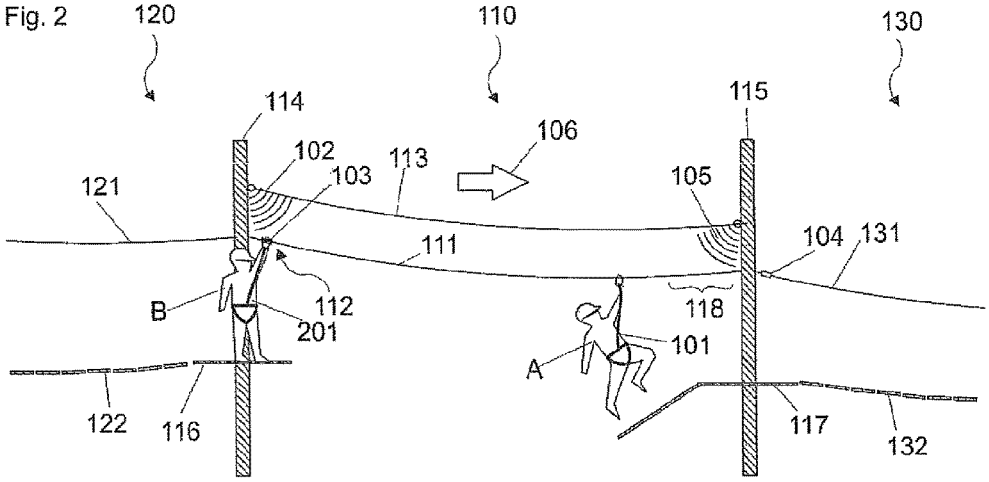
Figure 3:
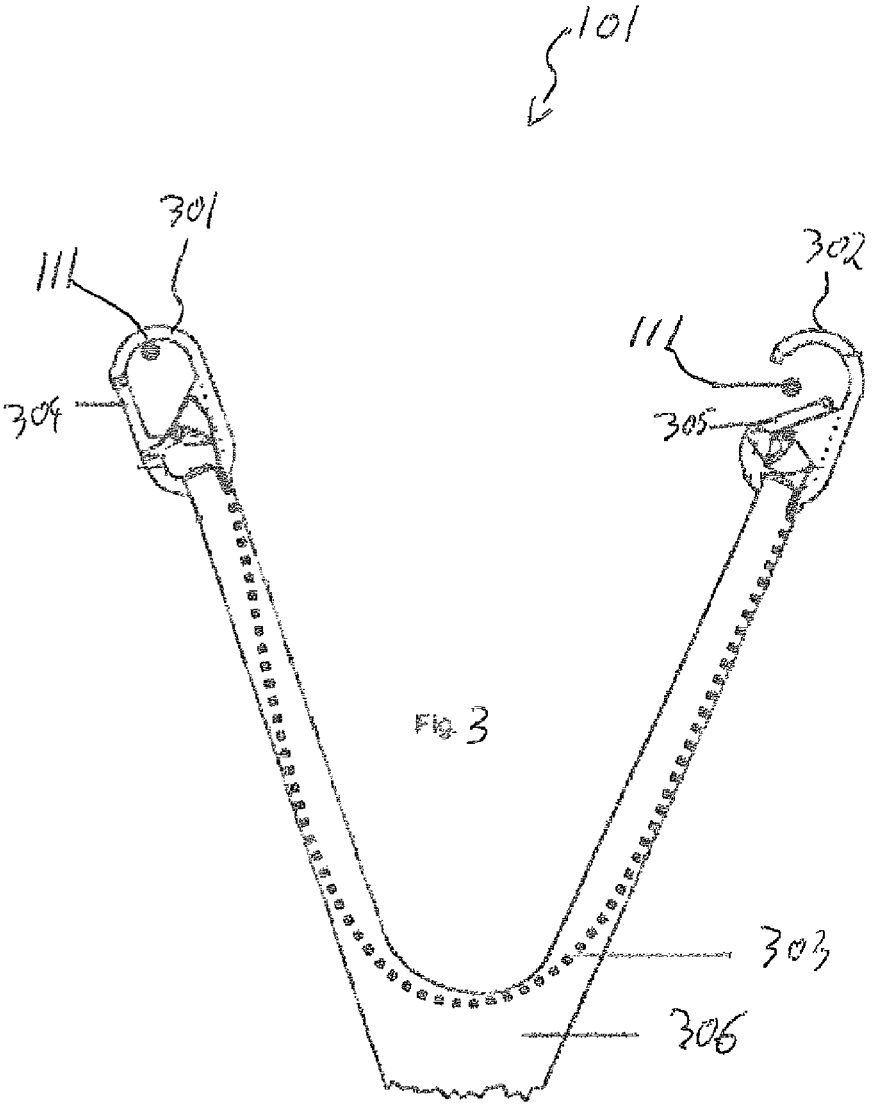
Figure 10:
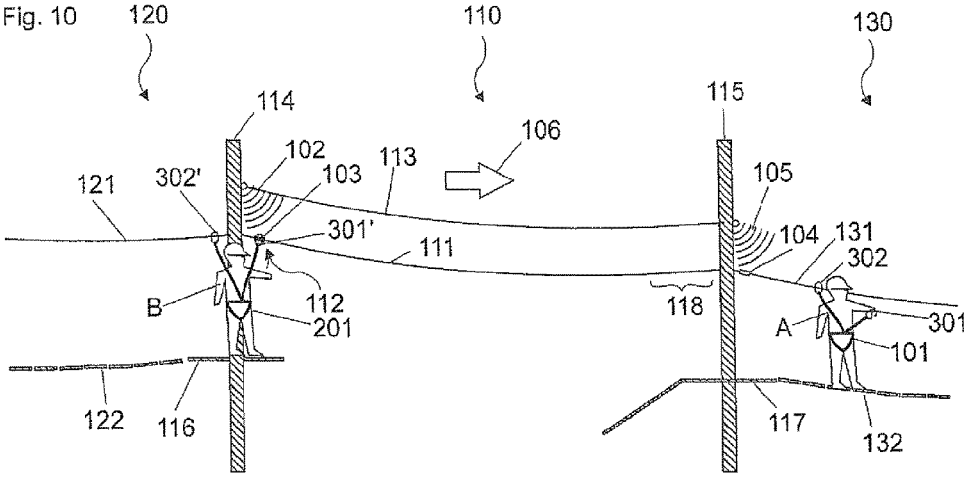
Figure 11:
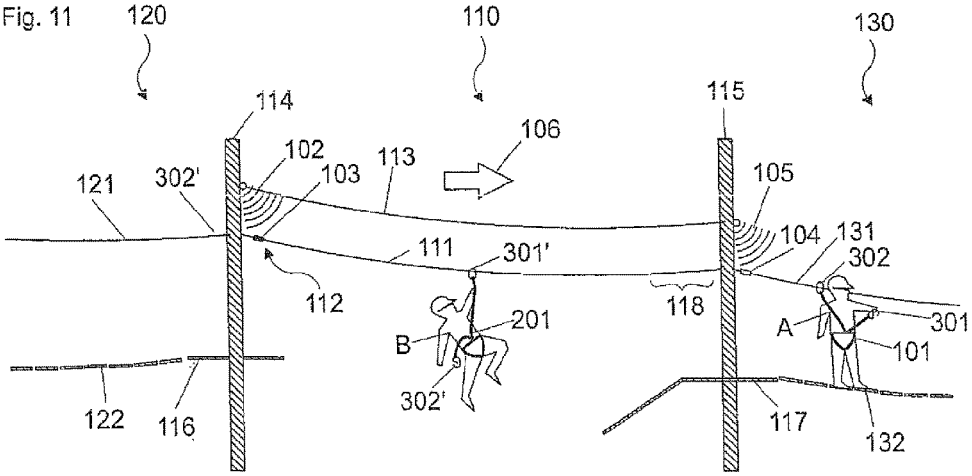
Figure 12:
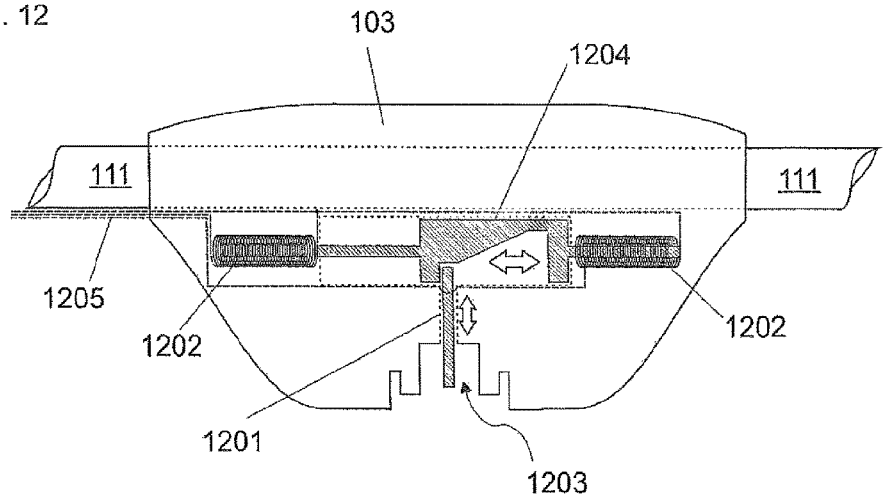
Figure 13:
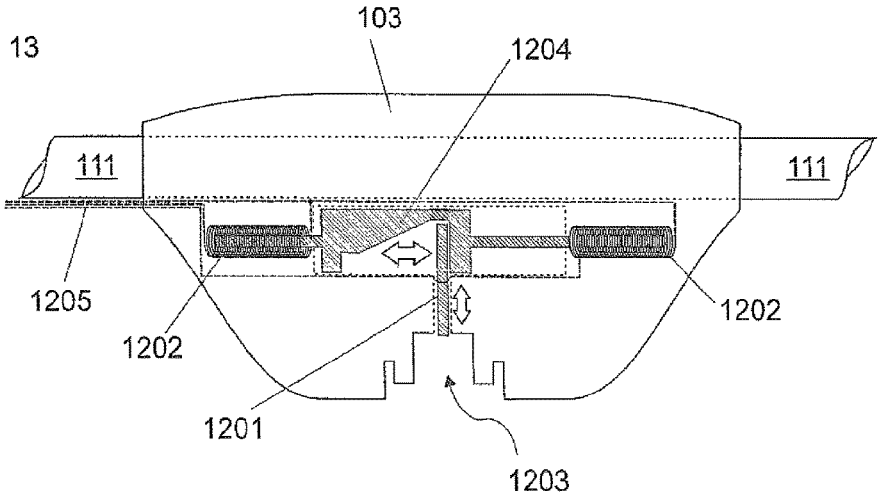

In the following, embodiment examples are described in more detail for a further explanation and for a better understanding of the present invention with reference to the drawings, in which:

FIG. 1 and FIG. 2 show schematic illustrations of a climbing park, in which the system according to an exemplary embodiment is used, FIG. 3 shows an exemplary embodiment of securing device according to an exemplary embodiment of the present invention, FIG. 4, FIG. 5, FIG. 6, FIG. 7, FIG. 8, FIG. 9, FIG. 10 and FIG. 11 show schematic illustrations of a climbing park, in which the system according to an exemplary embodiment is used, wherein in particular the securing device of FIG. 3 is used, FIG. 12 shows a schematic illustration of a key device in the clearance mode according to the exemplary embodiment of the present invention, and FIG. 13 shows a schematic illustration of a key device in the blocking mode according to the exemplary embodiment of the present invention.

DETAILED DESCRIPTION OF EXEMPLARY EMBODIMENTS

The same or similar components in different figures are provided with the same reference numerals. The representations in the figures are illustrated schematically.

FIG. 1 and FIG. 2 show a climbing park, which may have a guiding element 111, which may extend along a longitudinal direction (for example, the use direction 106), and along which a person A can move between a connecting (or hooking-in) section 112 of the guiding element 111 and a disconnecting (or hooking-out) section 118 of the guiding element 111.

The guiding element 111 may be, for example, a safety rope, which may be suspended and strained (or tensioned) along the exercise course 110. For example, the climbing park may have two attachment masts 114, 115, which may be arranged at a distance from each other (or mutually spaced), between which the guiding element 111 may be attached. The guiding element 111 may have, in particular, at the beginning of the exercise course 110, a connecting (or hooking-in) section 112, in which the person A may connect (or hook in) to the guiding element 111 by a securing device and/or a self-securing set 101. Towards the end of the exercise course 110, the guiding element 111 may have a disconnecting (or hooking-out) section 118, within which the person A may disconnect (or hook out) from the guiding element 111.

The climbing park may be, for example, a high rope garden, in which persons can perform different exercise courses 110, 120, 130, such as for example skill exercises or zip lines, at large heights. In the following, the exercise course 110 may be to be understood in particular as an exercise course, in which a person A may be located at a described (or particular) point in time. Accordingly, a preceding pre-exercise course 120 or a subsequent follow-up exercise course 130 may join relative to the exercise course 110. In other words, a person may thus complete at first the preceding pre-exercise course 120, may subsequently perform the exercise course 110, and may, after the performing of the exercise course 110, perform the subsequent follow-up exercise course 130.

The preceding pre-exercise course 120 may have, for example, a further guiding element 121 and a pedestrian bridge (alternatively also suspension bridge, flyingfox, or another climbing park element) 122. A person may thus walk along the pedestrian bridge 122 at a larger height and may be secured by connecting the securing set 101 to the further guiding element 121. A platform 116 may be fixed to the attachment mast 114, for example, at which the person A may stand for disconnecting from the further guiding element 121 and for connecting to the guiding element 111.

Accordingly, the follow-up exercise course 130 may have a further guiding element 131, which may extend from the further attachment mast 115 along the use direction 106. For example, the follow-up exercise course 130 may have a further pedestrian bridge 132.

Furthermore, a system for controlling a use of the exercise course 110 by a person A in the climbing park is shown. The system may have a securing device 101 for securing the person A to the guiding element 111, an identification device 102 and a key device 103.

The securing device 101 may be attachable movably along the guiding element 111 between the connecting section 112 and the disconnecting section 118, wherein the securing device 101 may be connectable to the guiding element 111 in the connecting section 112 and may be disconnectable from the guiding element 111 in the disconnecting section 118.

The identification device 102 may be configured such that, by the identification device 102, at least a connecting of the securing device 101 within the identification section may be identifiable, such that thereby an occupancy of the guiding element 111 with another person may be identifiable.

The actuating device of the securing device (in the following referred to as key device 103) may be controllable by the identification device 102, such that the key device 103, in a clearance (or release) mode, and upon identification of the occupancy of the guiding element 111 with another person, may be adjustable in a blocking mode. The key device may be coupled with (or to) the securing device 101, such that, in the blocking mode, a connecting of the securing device 101 in the connecting section 112 and/or a shifting (or displacement) of the securing device 101 along the guiding element 111 may be blocked.

The securing device 101 may serve for securing the person A to the guiding element 111. In an embodiment example, as shown in FIG. 1 and FIG. 2, the securing device 101 may have a connectable securing device (e.g. a carabiner element or a rope pulley), to which the person A may be fixed.

The identification device 102 may provide the information "exercise course 110 occupied" or "exercise course 110 not occupied". The identification device 102 may identify a connecting of the securing device 101 within an identification section.

The identification section may be defined in particular within the connecting section 112. The identification device 102 may, for example, determine, whether a person A passes by the identification section, such that an occupancy of the guiding element 111 within the exercise course 110 can be concluded.

The identification device 102 may have, for example, a RFID reader unit, which may be attached to the first attachment mast 114. The person A or the connectable securing device 101 may have a RFID transponder. The RFID reader unit may be configured to detect the RFID transponder of the connected securing device 101 or of the person A, so as to possibly identify a passing-by of the person A at the identification device 102. By the RFID reader unit and the RFID transponder, for example, a simple (or single) passing-by of the person A may be detected. In addition, the RFID transponder may have a particular code, which may be detected by the RFID reader unit. Thus, it may be determined, which RFID transponder is about to pass by the RFID reader unit. Thus, for example, a specific person A, who may carry the particular RFID transponder, may be identified. Thus, for example, it may be determined, how often the person A has already performed the exercise course 110. Further, the person A may be localized in the climbing park by a central control unit.

The further identification device 105 may be fixed, for example, to the further attachment mast 115. The further identification device 105 may detect, via a further RFID reader unit arranged in the region of the disconnecting section 118, a disconnecting of the person A and/or a further passing-by of the person A at the disconnecting section 110, such that an end of the occupancy of the guiding element 111 may be concluded.

The key device 103 may be adjusted by the identification device 102 in a clearance (or release) mode and in a blocking mode as a function of the occupancy of the exercise course 110 and/or of the guiding element 111 by a person A.

In FIG. 1, the identification device 102 may detect no person within the exercise course 110 and/or no person, who may be coupled to the guiding element 111, such that the key device 103 may be adjusted in a clearance mode. In the clearance mode, the securing device 101 of the person A may be coupled to the guiding element 111 in the connecting section 112, and may be shifted along the guiding element 111.

In FIG. 2, the identification device 102 may detect the person B within the exercise course 110. Accordingly, the key device 103 may be adjusted in a blocking mode. In the blocking mode, the further securing device 201 of the person B cannot be coupled to the guiding element 111 in the connecting section 112 and cannot be shifted along the guiding element 111.

Only if the further identification device 105 may have detected a decoupling of the person A from the disconnecting section 118, the identification device 102 may control the key device 103 in the clearance mode, such that the further securing device 201 may be connectable to the guiding element 111 in the connecting section 112.

The further identification device 105 may further determine the occupancy of the further guiding element 131 of the follow-up exercise course 130.

The identification device 102 and the further identification device 105 may be coupled with each other, for example, by a signal line 113 or wirelessly 105 for the exchange of signals.

In the example shown, the key device 103 may be fixed to the guiding element 111. In the clearance mode, the key device 103 may enable that the securing device 101 may be coupled to the guiding element 111 in the connecting section 112, and may be shifted along the guiding element 111. In the blocking mode, the key device 103 may block and may disable a disconnecting of the securing device 101, 201 from the guiding element 111 in the connecting section 112 and/or may block and may prevent a shifting of the securing device 101, 201 along the guiding element 111.

FIG. 3 shows an exemplary embodiment of a securing device 101 according to an exemplary embodiment of the present invention.

The securing device 101 may have a first connectable securing device 301 and a second connectable securing device 302. The securing device 101 may be configured such that either the first connectable securing device 301 or the second connectable securing device 302 may be adjustable in an opening position for coupling and decoupling. The key device 103 may communicate with the securing device 101, such that an opening of the second connectable securing device 302 may be selectively blockable.

The first connectable securing device 301 may have a first blocking device 304, and the second connectable securing device 302 may have a second blocking device 305. The first blocking device 304 may selectively control the opening position of the first connectable securing device 301, and the second blocking device 305 may selectively control the opening position of the second connectable securing device 302. The first blocking device 304 and the second blocking device 305 may be embodied, for example, as locking pins.

The securing device 301 further may have a coupling mechanism 303, which may be coupled with the first blocking device 304 and with the second blocking device 305, such that only one of the connectable securing devices 301, 302 and/or [one of] their blocking devices 304, 305 may be adjustable in the opening position, while the other blocking device 304, 305 may be adjusted in the blocking mode. The coupling mechanism 303 may be embodied, for example, mechanically as a Bowden cable, and may be coupled, respectively, to the first blocking device 304 and to the second blocking device 305. The coupling mechanism 303 may be substantially surrounded over the entire length between the securing device 301 and the first blocking device 304 by protection jacket 306.

FIG. 4 to FIG. 11 show schematic illustrations of the climbing park of FIG. 1 and FIG. 2. By contrast to the system of the present invention shown in FIG. 1 and FIG. 2, the system according to the invention of FIG. 4 to FIG. 11 has a securing device 101 according to the embodiment example of FIG. 3.

Figure 4:
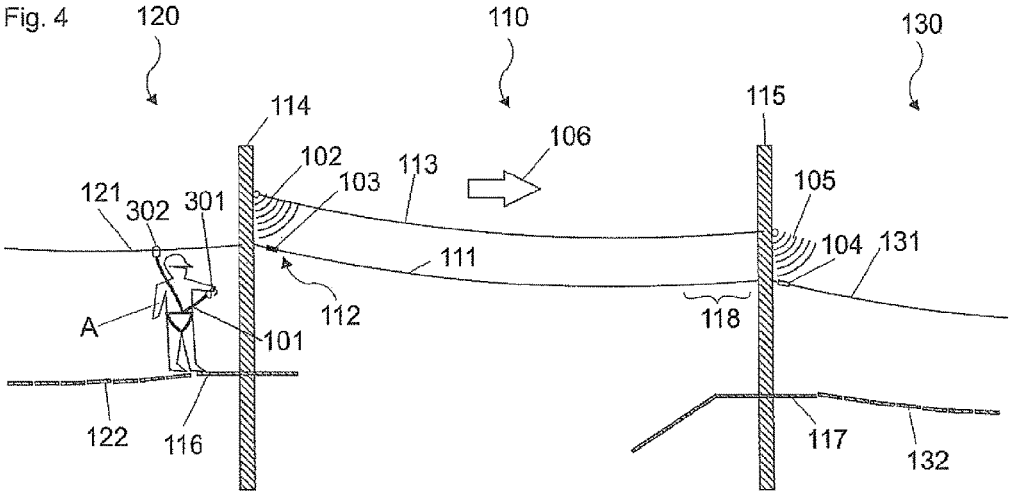

In FIG. 4, the person A may be located in a disconnecting section of the pre-examination course 120. The person A may be coupled to the further guiding element 121 by the second connectable securing device 302. The first connectable securing device 301 may be disconnected from the guiding element 121.

Figure 5:
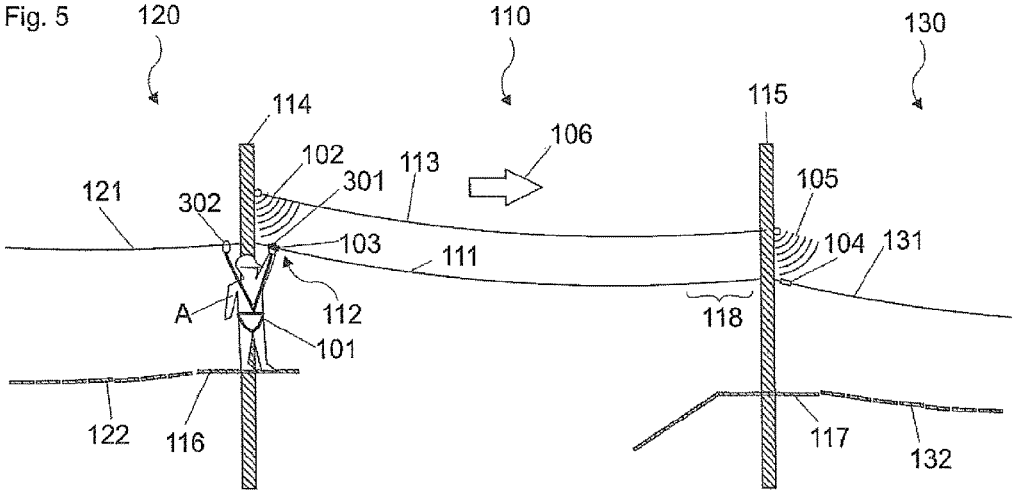

In FIG. 5, the person A may be located on the platform 116. The identification device 102 may detect that the guiding element 111 of the exercise course 110 may not be occupied. Accordingly, the identification device 102 may control the key device 103 in the clearance mode. The person A may couple the first connectable securing device 301 to the guiding element 111.

Figure 6:
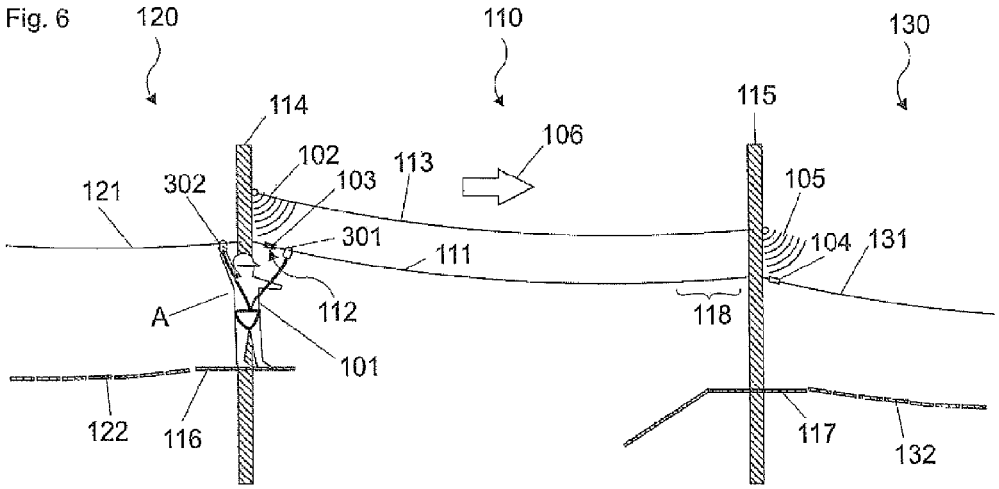

In FIG. 6, the person A may be coupled to the guiding element 111 by the first connectable securing device 301. Due to the clearance mode of the key device 103, the person A may remove the second connectable securing device 302 from the preceding further guiding element 121 of the pre-exercise course 120, such that a shifting of the self-securing set 101 along the use direction 106 may be possible.

Figure 7:
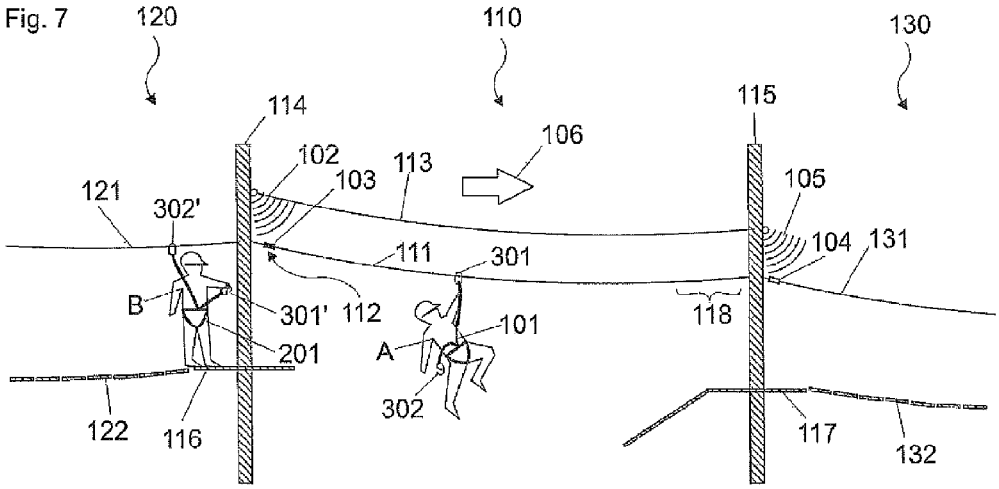

In FIG. 7, the person A may perform the exercise course 110, and may hang, for example, by the first connectable securing device 301, at the guiding element 111. Meanwhile, the person B may approach the platform 116. The person B may be secured by the further securing device 201. The person B may be secured to the further guiding element 121 by a second connectable securing device 302'. The first securing device 301' may be released from the further guiding element 121.

Figure 8:
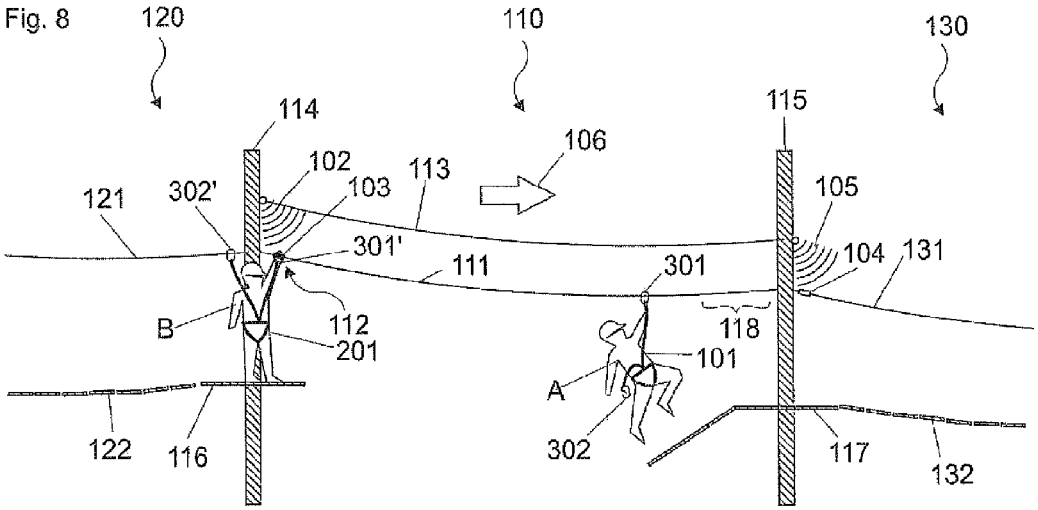

In FIG. 8, the person B may try to couple himself to the guiding element 111 of the exercise course 110. However, the identification device 102 may detect an occupancy of the exercise course 110 by the person A. Accordingly, the identification device 102 may control the key device 103 in the blocking mode.

Depending on the embodiment, the key device 103, in the blocking mode, may prevent that either the first connectable securing device 301' cannot be coupled to the further guiding element 111, or the key device 103 in the blocking mode may prevent that the second connectable securing device 302' cannot be released from the further guiding element 121 of the pre-exercise course 120. Both result in that the person B cannot perform the exercise course 110 as long as the key device 103 is not controlled in the clearance mode.

Figure 9:
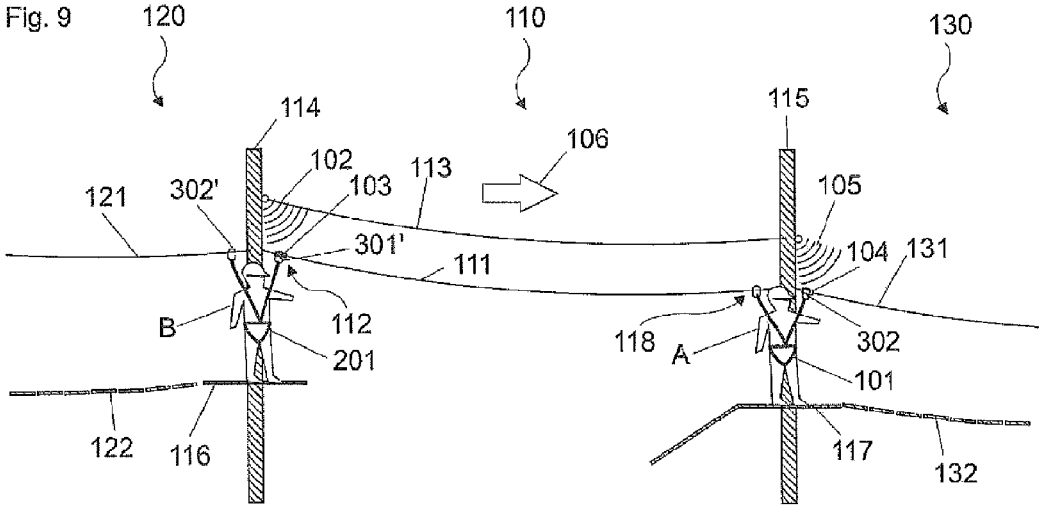

In FIG. 9, the person A may have arrived at the further platform 117 in the meantime, and thus may have finished the exercise course 110. Accordingly, the person A may couple the second connectable securing device 302 to the further guiding element 131 of the subsequent further follow-up exercise course 130. The finishing of the exercise course 110 may be detected, for example, by the further identification device 105. This information may be transmitted from the further identification device 105 to the identification device 102 via the signal line 113.

Accordingly, the identification device 102 may control the key device 103 in the clearance mode, because the exercise course 110 may no longer be occupied by the person A.

In FIG. 10, the person A may be located in the performing of the further follow-up exercise course 130. Due to the clearance mode of the key device 103, the person B may now couple the first connectable securing device 301' to the guiding element 111, or may release the second connectable securing device 302' from the further guiding element 121 of the pre-exercise course 120.

FIG. 11 shows the person A during the performing of the follow-up exercise course 130. Meanwhile, the person B may perform the exercise course 110. The follow-up course 130 includes a guiding element of the follow-up exercise course 131 with a further key device 104 coupled to or fixed to the guiding element of the follow-up course 131.

FIG. 12 and FIG. 13 show a key device 103, which may be configured for fixing to the guiding element 111.

The key device 103 may have a key pin 1201. At least the first connectable securing device 301 may have a key lock, which may be coupleable with the key pin 1201. The first connectable securing device 301 may be configured such that, upon coupling the key lock with the key pin 1201, the coupling means 303 may control the second blocking device 305, such that the second connectable securing device 302 and/or the second blocking device 305 may be adjustable in the opening position. Upon coupling the key pin 1201 in the key lock, for example a spring mechanism or an electrical pulse may be activated, which may prompt the coupling element 303 to possibly adjust or to possibly block the second blocking device 305 in the opening position.

The key pin 1201 may be adjustable in an active position (see FIG. 12) and in a passive position (FIG. 13), in particular pullable in and movable out.

In the active position, as is illustrated in FIG. 12, the key pin 1201 may be moved out and accordingly may be coupleable with the key lock.

In the passive position, as is illustrated in FIG. 13, the key pin 1201 may be pulled in, and a coupling of the key pin 1201 with the key lock may be blocked. In the blocking mode of the key device 103, the key pin 1201 may thus be adjusted in the passive position, such that a coupling with the key lock of the first connectable securing device 301 may be blocked. Accordingly, for example, the coupling means 303 may not be actuated, such that the coupling means 303 may not release (or clear) the second blocking device 305 of the second connectable securing device 302 and may not move in the opening position.

The key device 103 may have an adjusting device for adjusting the key pin 1201, wherein the adjusting device may have an electromagnet 1202. The adjusting device may be coupled with the identification device 102 for signal transmission, for example by a transmission line 1205, such that the identification device 102 possibly controls the adjusting device as a function of the occupancy status of the guiding element 111 of the exercise course 110.

For this purpose, the adjusting device may have, for example, a guide piston 1204, which may be adjusted along an adjustment direction by the electromagnets 1202. The guide piston 1204 may, for example, have a guide notch, in which the key pin 1201 may be attached. The depth of the guide notch may vary along the adjusting direction. The key pin 1201 may be pushed into the guide notch, for example by a spring mechanism, wherein, upon adjusting the guide piston 1204 along the adjusting direction, the key pin 1201 may be pullable in and movable out. In particular, the key pin 1201 may be pullable in and movable out along a pull-in direction, which may be orthogonal to the displacement direction of the guide piston 1204.

Furthermore, the key device 103 may have a recess 1203, in which the first connectable securing device 301 may be inserted until the first connectable securing device 301 may be adjusted in a coupling position, such that in the case of the clearance mode, the key pin 1201 may be penetrable into the key lock. The recess 1203 may thus serve as a guide connecting member for the first connectable securing device 301.

Supplementary, it is to be noted that "comprising" or "having" does not exclude other elements or steps, and that "a" or "an" does not exclude a plurality. Furthermore, it is noted that features or steps, which have been described with reference to one of the above embodiment examples, can also be used in combination with other features or steps of other embodiment examples described above.

LIST OF REFERENCE NUMERALS

101 securing device
102 identification device
103 key device
104 further key device
105 further identification device
106 use direction of the exercise device course
110 exercise course
111 guiding element
112 connecting (or hanging-in) section
113 signal line
114 attachment mast
115 further attachment mast
116 platform
117 further platform
118 disconnecting (or hanging-out) section
120 pre-exercise course
121 guiding element of the pre-exercise course
122 pedestrian bridge
130 follow-up exercise course
131 guiding element of the follow-up exercise course
132 pedestrian bridge
201 further securing device
301 first connectable securing device
302 second connectable securing device
303 coupling mechanism
304 first blocking device
305 second blocking device
306 protection jacket
1201 key pin
1202 electromagnet
1203 recess
1204 guide piston
1205 transmission line
A person
B further person

The invention claimed is:

1. A system for controlling a use of an exercise course by a person, the exercise course having a guiding element along which a first person can move between a connecting section of the guiding element and a disconnecting section of the guiding element, wherein at least in the connecting section an identification section is formed, the system comprising:

a securing device configured to secure the person to the guiding element, wherein the securing device is movably attachable along the guiding element between the connecting section and the disconnecting section, wherein the securing device is connectable to the guiding element in the connecting section and is disconnectable from the guiding element in the disconnecting section, an identification device, which is configured such that at least a connecting of the securing device within the identification section is identifiable by the identification device, such that thereby an occupancy of the guiding element by another person is identifiable, and an actuating device of the securing device, which actuating device is controllable, based on an identification result of the identification device, such that the actuating device for the securing device is adjustable in a clearance mode and, upon identification of the occupancy of the guiding element by another person, in a blocking mode, wherein the actuating device of the securing device is coupleable or coupled to the securing device, such that, in the blocking mode, a connecting of the securing device in the connecting section and/or a displacing of the securing device between the connecting section and the disconnecting section of the guiding element are blocked.

2. The system according to claim 1, wherein the securing device has a rope pulley, to which the person is attached.

3. The system according to claim 1, wherein the securing device has a first connectable securing device, to which the person is attached.

4. The system according to claim 3, wherein the securing device has a second connectable securing device, to which the person attached, wherein the securing device is configured such that either the first connectable securing device or the second connectable securing device is adjustable in an opening position for coupling or decoupling.

5. The system according to claim 4, wherein the actuating device of the securing device communicates with the securing device, such that an opening of the second connectable securing device is selectively blockable.

6. The system according to claim 5, wherein the first connectable securing device has a first blocking device and the second connectable securing device has a second blocking device, wherein the first blocking device selectively controls the opening position of the first connectable securing device, and the second blocking device selectively controls the opening position of the second connectable securing device.

7. The system according to claim 6, wherein the securing device has a coupling means, which is coupled to the first blocking device and to the second blocking device, such that only one of the connectable securing devices is adjustable in the opening position.

8. The system according to claim 7, wherein the actuating device of the securing device is fixable to the guiding element, for example a guiding rope, in the connecting section, wherein the actuating device of the securing device has a key pin, wherein at least the first connectable securing device has a key lock, which is coupleable with the key pin, wherein the first connectable securing device is configured such that, upon coupling the key lock with the key pin, the coupling means controls the second blocking device, such that the second connectable securing device is adjustable in the opening position.

9. The system according to claim 8, wherein the key pin is adjustable in an active position and in a passive position, wherein, in the active position, the key pin is coupleable with the key lock and, in the passive position, a coupling of the key pin with the key lock is blocked.

10. The system according to claim 9, wherein the actuating device of the securing device has an adjusting device for adjusting the key pin, wherein the adjusting device has an electromagnet and/or a servo motor.

11. The system according to claim 1, wherein the identification device has a RFID reader unit, which is configured to detect a RFID transponder of the securing device or of the person, so as to identify a passing-by of the person at the identification device.

12. The system according to claim 1, further having a further identification device, which is coupled to the guiding element, such that a disconnecting of the securing device is identifiable within the disconnecting section by the further identification device, such that the occupancy of the guiding element is further identifiable therewith.

13. The system according to claim 12, wherein the identification device and the further identification device are coupled for exchanging signals with each other.

14. The system according to claim 13, wherein the identification device and the further identification device are coupled to the guiding element, such that signals are exchangeable along the guiding element between the identification device and the further identification device.

15. An actuating device of a securing device, for controlling a use of an exercise course by a person, which actuating device has a guiding element, along which a person can move between a connecting section of the guiding element and a disconnecting section of the guiding element, wherein at least in the connecting section an identification section is formed, wherein a securing device for securing a person to the guiding element is provided, wherein the securing device is movably attachable along the guiding element between the connecting section and the disconnecting section, wherein the securing device is connectable to the guiding element in the connecting section and is disconnectable from the guiding element in the disconnecting section, wherein an identification device is configured such that at least a connecting of the securing device within the identification section is identifiable by the identification device, such that therewith an occupancy of the guiding element by another person is identifiable, wherein the actuating device of the securing device is controllable, based on an identification result of the identification device, such that the actuating device of the securing device is adjustable in a clearance mode and, upon identification of the occupancy of the guiding element by another person, in a blocking mode, wherein the actuating device of the securing device is coupleable with the securing device, such that, in the blocking mode, a connecting of the securing device in the connecting section and/or a displacement of the securing device between the connecting section and the disconnecting section of the guiding element are blocked.

16. A method for operating a system for controlling a use of an exercise course by a person in a climbing park according to claim 1, the method, comprising:

identifying a connecting of the securing device in the identification section by the identification device, such that an occupancy of the guiding element by another person is identifiable therewith, and controlling the actuating device of the securing device with the identification device in the clearance mode or, if the guiding element occupied by another person, in the blocking mode.

* * * * *